US009568264B2

(12) United States Patent
Graves

(10) Patent No.: US 9,568,264 B2
(45) Date of Patent: Feb. 14, 2017

(54) FLEX-FIRE TECHNOLOGY

(71) Applicant: Thomas Allen Graves, Buda, TX (US)

(72) Inventor: Thomas Allen Graves, Buda, TX (US)

( * ) Notice: Subject to any disclaimer, the term of this patent is extended or adjusted under 35 U.S.C. 154(b) by 0 days.

(21) Appl. No.: 14/850,380

(22) Filed: Sep. 10, 2015

(65) Prior Publication Data

US 2016/0102933 A1 Apr. 14, 2016

Related U.S. Application Data

(60) Provisional application No. 62/049,323, filed on Sep. 11, 2014.

(51) Int. Cl.
*F41A 19/16* (2006.01)
*F41A 17/46* (2006.01)
*F41A 3/68* (2006.01)

(52) U.S. Cl.
CPC ..... *F41A 17/46* (2013.01); *F41A 3/68* (2013.01); *F41A 19/16* (2013.01)

(58) Field of Classification Search
CPC ..... F41A 19/06; F41A 19/10; F41A 19/24; F41A 19/32
USPC ..... 42/69.02; 89/136
See application file for complete search history.

(56) References Cited

U.S. PATENT DOCUMENTS 571,260 A 11/1896 Borchardt
580,925 A 4/1897 Browning
3,657,959 A 4/1972 Kart
4,127,056 A 11/1978 Kart
4,253,377 A 3/1981 Arnett
4,455,777 A 6/1984 Callies
4,459,774 A 7/1984 Ferretti
4,539,889 A 9/1985 Glock
4,735,009 A 4/1988 Jett, Jr.
4,955,157 A 9/1990 Brighton et al.
5,036,612 A 8/1991 Jennings
7,398,723 B1 7/2008 Blakley
8,448,366 B2 5/2013 Faifer
8,701,326 B2 4/2014 Zonshine
9,021,732 B2 * 5/2015 Johnson ..... F41A 19/09 42/69.01
2011/0289813 A1 12/2011 Serandour
2014/0366418 A1 12/2014 Stakes
2015/0184967 A1 7/2015 Whittington

FOREIGN PATENT DOCUMENTS

GB 18774 0/1893

OTHER PUBLICATIONS http://tacconusa.com/ Tac Con 3MR Trigger System.

* cited by examiner

*Primary Examiner* — Reginald Tillman, Jr.
(74) *Attorney, Agent, or Firm* — Timothy D. Bennett; Emerson Thomson Bennett

(57) ABSTRACT

A handheld finger activated semi-automatic arm may include a barrel, a trigger, a moveable gun bolt and a trigger reset mechanism. The trigger reset mechanism may use rigid mechanical contact between the trigger and the gun bolt during an earliest portion of the operating cycle. The trigger may be blocked from depression by the gun bolt up to 99% of the operating cycle.

5 Claims, 3 Drawing Sheets

FLEX-FIRE TECHNOLOGY

This application claims priority to U.S. Ser. No. 62/049,323, entitled FLEX-FIRE TECHNOLOGY, filed Sep. 11, 2014, which is incorporated herein by reference.

I. BACKGROUND

A. Field of the Invention

This invention is related to semi-automatic arms and more specifically is related to reciprocating gun bolt driven trigger and integrated safety mechanisms. This invention is primarily focused upon original product type integrated fire control systems of semi-automatic arms as opposed to any external attachments or auxiliary means. This invention is also primarily focused on striker fired semi-automatic arms as opposed to hammer fired semi-automatic arms.

B. Description of Related Art

In the art associated with modern trigger operated semi-automatic arms, it is desirable to secure rapid and repeated shot placement.

The concept of a semi-automatic arm includes a manually activated trigger that fires once per operating cycle. An operating cycle is comprised of two gun bolt strokes. Each operating cycle requires an independent depression and reset of the trigger.

Low Energy Trigger Reset

A popular finger manipulated trigger operating concept is commonly referred to as "trigger reset." This is the prevailing concept of conventional trigger operated semi-automatic arms. In this concept, a trigger is pulled to fire. After the trigger is pulled it must be released to a position of mechanical reset by spring tension before subsequent trigger operating cycles can be accomplished. A device functioning as a disconnector or an equivalent arrangement of devices is used to hold the striker/firing pin until the trigger is reset. In this case, the energy for trigger depression is supplied by the user and the energy for trigger reset is stored user energy via mechanical spring tension. In general practice, reset spring energy is relatively low in order to provide a light trigger pull.

Medium Energy Trigger Reset

A medium energy trigger reset type fire control system can develop more reset stroke energy than a low energy trigger reset system without necessarily increasing trigger pull weight. In a medium energy trigger reset system some fraction of energy transferred from a moving gun bolt is transmitted ultimately to a trigger. This energy increase of the trigger reset is taken from gun bolt operation energy, not trigger depression energy.

Trigger depression energy may be very low (indicating a light trigger pull) while having a relatively faster and/or stronger trigger reset event than otherwise possible. A characteristic of this system is that if one pulls a trigger forcefully enough it will not reset automatically because gun bolt energy is transmitted through a disconnector and then through the trigger that is separated by a spring of higher resistance than the usual trigger reset spring. If force on the trigger exceeds the resistance of this spring then the trigger will not reset but the disconnector will function regardless.

II. SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

It is possible by the application of Flex-Fire Technology (FFT) to have a high energy trigger reset system. A high energy trigger reset system implies a trigger that is reset by direct mechanical reaction to a gun bolt without the necessity of a spring system limiting trigger reset energy. Such a system can easily have more trigger reset energy than a finger can apply within a broad range of practical concern. This can assure a more certain reset event under more diverse conditions than is otherwise possible, and also allows for further design flexibilities that were previously unobtainable. The FFT reset system is capable of maximized trigger reset energy and trigger spring weight is independent of trigger reset energy. FFT can provide the basic advantages of true high energy trigger reset technology within the context of a trigger operated semi-automatic arm suited for industry wide applications.

According to some embodiments of this invention, a handheld finger activated semi-automatic arm may comprise: a frame; a chamber face that is supported to the frame and that comprises a barrel; a trigger that is depressible to fire the arm once per operating cycle; a gun bolt that is movable rearward and forward with respect to the frame; and, a trigger reset mechanism comprising rigid mechanical contact between the trigger and the gun bolt during an earliest 50% of the operating cycle. The trigger may be blocked from depression by the rigid mechanical contact between the trigger and the gun bolt up to 99% of the operating cycle.

According to other embodiments of this invention, a handheld finger activated semi-automatic arm may comprise: a frame; a chamber face that is supported to the frame and that comprises a barrel; a trigger that is depressible to fire the arm once per operating cycle; and, a gun bolt that is movable with respect to the frame rearward away from the chamber concurrent with the trigger being positively mechanically reset. The trigger may be blocked from depression until up to 99% of the operating cycle.

According to still other embodiments of this invention, a handheld finger activated semi-automatic arm may also comprise: a safety lock that engages a sear surface on a disconnector to prevent trigger depression.

According to yet other embodiments of this invention, a handheld finger activated semi-automatic arm may also comprise: a striker having an integrated sear surface; a striker biasing member that biases the striker toward a forward position; a disconnector having: a first sear surface in contact with the striker sear surface; a second sear surface; and, a pivot that is rearward of the striker sear surface and forward of the disconnector second sear surface; and, a safety lock that is adjustable between: a locked condition which prevents the trigger from being depressed and an unlocked condition which permits the trigger to be depressed. The safety lock may contact the disconnector second sear surface when the safety lock is in the locked condition. The safety lock may be out of contact with the disconnector second sear surface when the safety lock is in the unlocked condition. The arm may be operable when the safety lock is in the unlocked condition by depressing the trigger to pivot the disconnector about the disconnector pivot, to move the first disconnector sear surface out of contact with the striker sear surface, to enable the striker biasing member to force the striker to fire the arm.

According to other embodiments of this invention, a handheld finger activated semi-automatic arm may also comprise: a striker having an integrated sear surface; and, a striker biasing member that biases the striker toward a forward position. When the gun bolt is moving forward, the striker compresses the striker biasing member.

According to still other embodiments of this invention, a handheld finger activated semi-automatic arm may also comprise: a striker having an integrated sear surface at a rearward end; and, a striker biasing member that is positioned above or beside the striker from a lengthwise perspective. The striker and striker biasing member may be charged only as the gun bolt moves forward toward the chamber face.

According to yet other embodiments of this invention, a handheld finger activated semi-automatic arm may comprise: a frame; a chamber face that is supported to the frame and that comprises a barrel; a striker having an integrated sear surface at a rearward end; a striker biasing member that is positioned above or beside the striker from a lengthwise perspective; a gun bolt that is movable rearward and forward with respect to the frame; and, a trigger that is depressible to fire the arm. The striker and striker biasing member may be charged only as the gun bolt moves forward toward the chamber face.

Numerous benefits and advantages of this invention will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
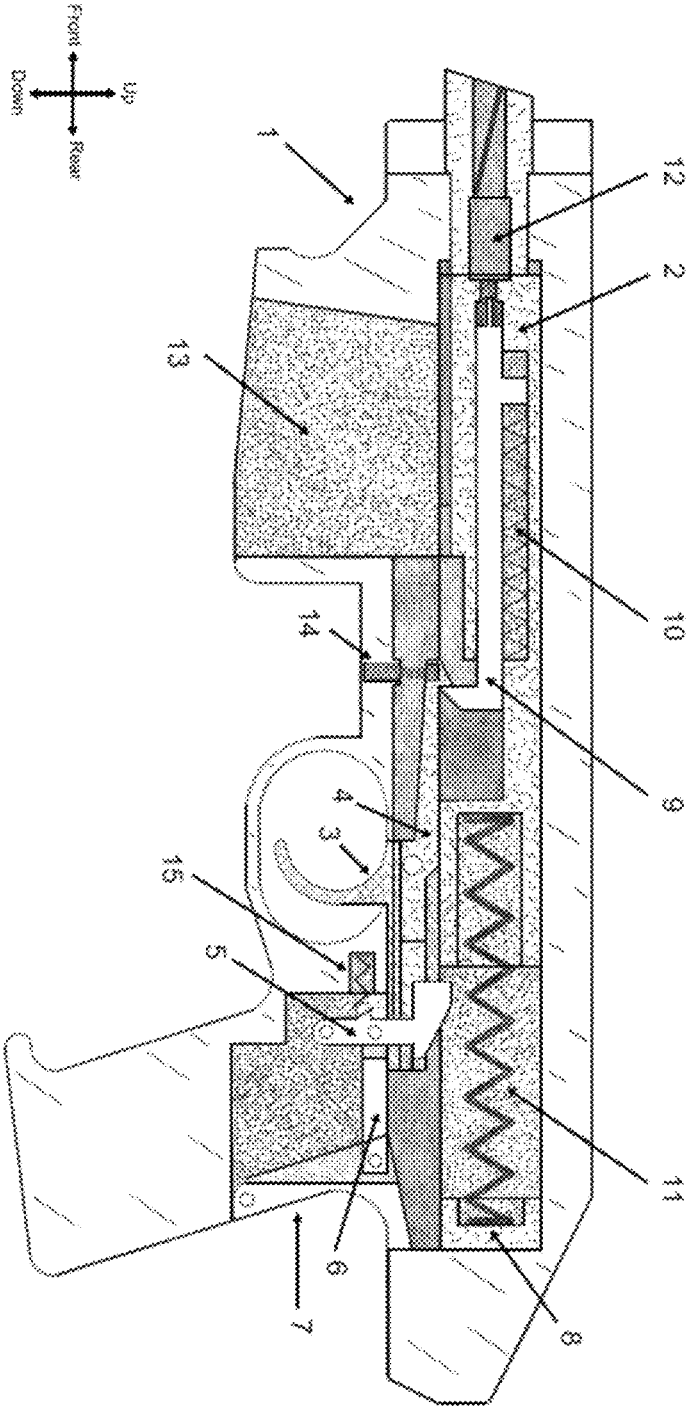
FIG. 1 is a side view, in partial cutaway, showing an arm equipped with embodiments of the Flex-Fire Technology of this invention.

Referring now to the drawings wherein the showings are for purposes of illustrating embodiments of the invention only and not for purposes of limiting the same, and wherein like reference numerals are understood to refer to like components, following is a list of components according to some embodiments of this invention:

1: A frame (stationary part)
2: A gun bolt (reciprocating type)
3: A trigger
4: A disconnector (integrated safety sear type)
5: A safety lock
6: A safety transfer bar
7: A safety paddle (engagement device)
8: A buffer (elastic bushing type)
9: A striker (integrated sear type)
10: A striker biasing member which may be a spring (helical compression type)
11: A main recoil biasing member which may be a spring (helical compression type)
12: A chamber face (barrel and chamber assembly)
13: A magazine (standard box magazine—details omitted for clarity)
14: A disconnector biasing member which may be a spring (helical compression type)
15: A safety biasing member which may be a spring (helical compression type)
16: Sear surface of disconnector 4
17: Pivot
18: Sear surface of striker 9
19: Bottom surface of gun bolt 2
20: Sear surface of disconnector 4
21: Space between gun bolt 2 and trigger 3
22: Top surface of trigger 3

Figure 2:
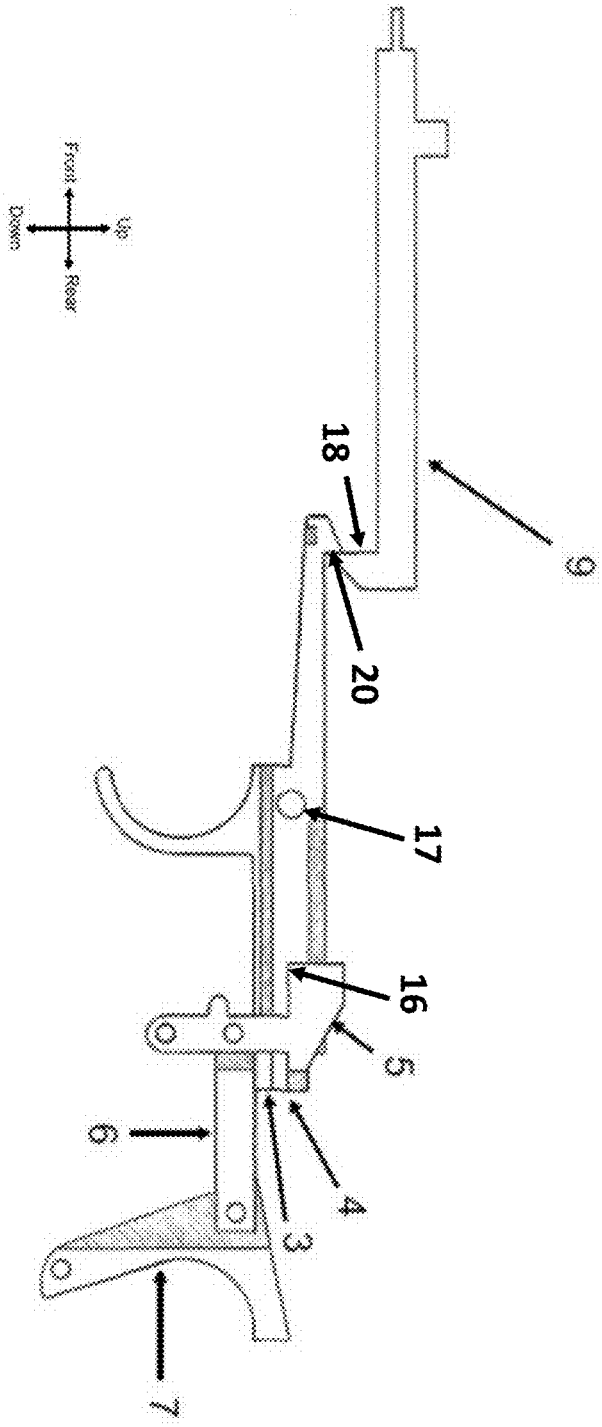
FIG. 2 shows portions of the arm of FIG. 1 separated for clarity.
Figure 3:
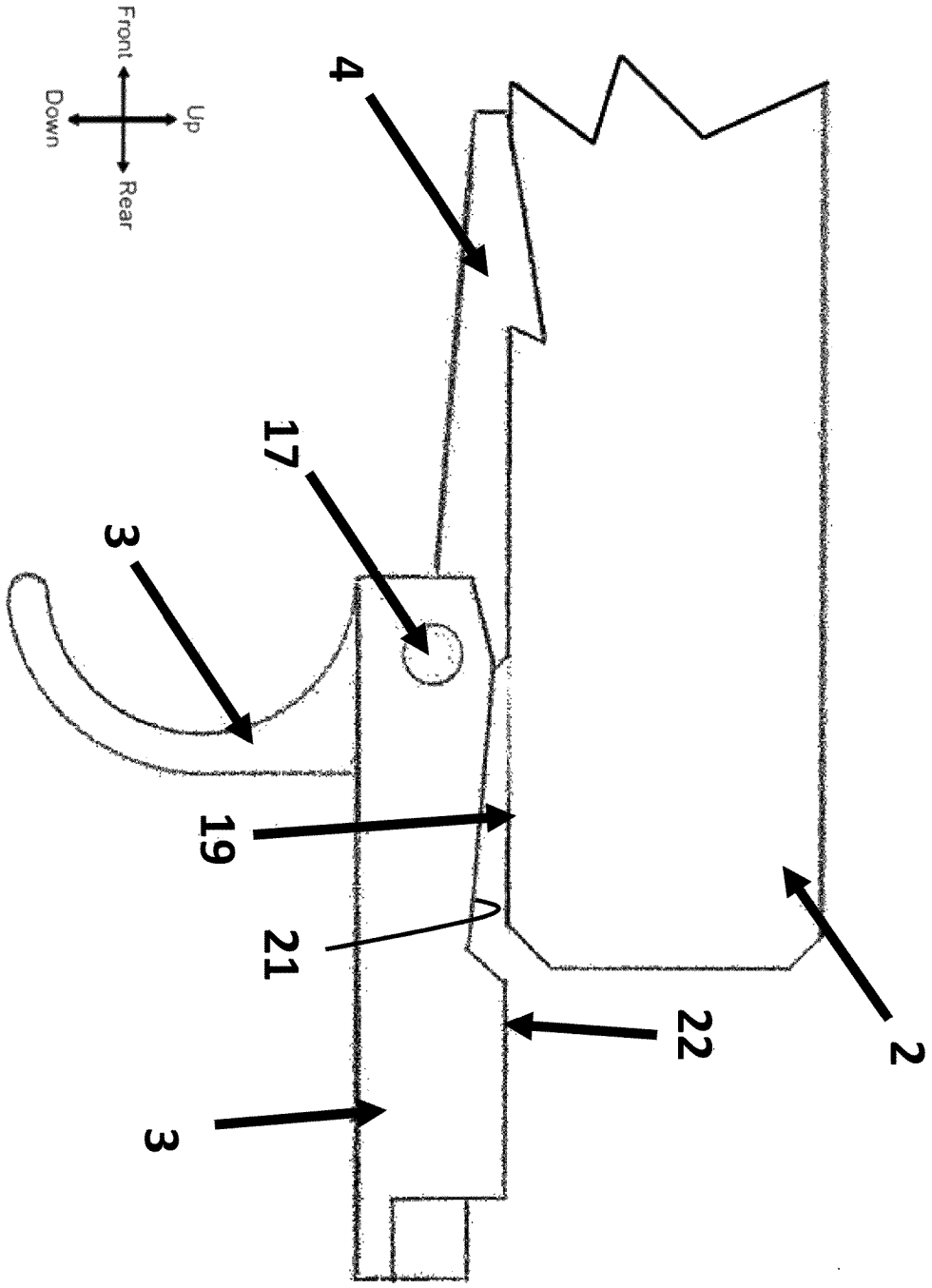
FIG. 3 shows portions of an arm with components similar to those shown in FIG. 1 but with numerous components removed for clarity. The gun bolt is shown in the full frontward position and the trigger is shown in the non-depressed position.

With reference now to FIGS. 1, 2 and 3, Flex-Fire Technology (FFT), is designed to fire common cartridge type ammunition (not shown) from within chamber 12. The system is operated by hand and trigger 3 is finger activated by depressing trigger 3 in the rearward direction. In order to initiate an operational cycle from the loaded chamber 12, safety paddle 7 may be depressed towards the chamber 12 by user energy. This depression moves safety transfer bar 6 against biasing member 15 and simultaneously pivots safety lock 5 towards the chamber 12 (clockwise). When the safety lock 5 is depressed to a given extent, it swings clear of sear surface 16 on the disconnector 4. Once the disconnector 4 and trigger 3 are free to swing upwards (counterclockwise) the FFT is ready to fire a cartridge.

Depression of the trigger 3 by a user will now result in a cartridge being fired and an operational cycle to be completed to the extent of reloading chamber 12 from magazine 13 in preparation for a subsequent depression of the trigger 3. Reloading details have been omitted for clarity.

Upon depression of the trigger 3, the trigger 3 and the disconnector 4 will pivot upwards (counterclockwise) about pivot 17 farthest from the chamber 12. Note in FIG. 3 the space 21 between the top of the trigger 3 and the bottom of the gun bolt 2 that provides room for this pivoting motion when the gun bolt 2 is positioned forward. The disconnector 4 acts against a disconnector biasing member 14 and is pulled downward at any point forward of the trigger pivot 17. As the disconnector 4 breaks contact with sear surface 18 on striker 9, striker 9 will react against striker biasing member 10 and fire a cartridge via stored kinetic energy.

Ultimately, as a cartridge is fired and a bullet is propelled away from the gun bolt 2, subsequent recoil energy pushes the cartridge case away from the chamber 12—pushing the gun bolt 2 rearwardly in the process. During this movement the cartridge case will travel at least its own original length while in direct contact with the gun bolt 2 and then it will be ejected in the usual manner, which has been omitted for clarity. The ejection function, including the compression of main recoil biasing member 11, is performed in parallel with overall fire control group reset.

During the earliest rearward movement of the gun bolt 2, the trigger 3 is forced to reset by interference contact with the gun bolt 2. Specifically, in one embodiment shown in FIG. 3, bottom surface 19 of the gun bolt 2 contacts upper surface 22 of the trigger 3 as the gun bolt 2 moves rearward. The gun bolt 2 may then hold down the trigger 3 throughout the remaining rearward movement. During this movement the disconnector 4 is elastically displaced (compressing disconnector biasing member 14) as striker 9 passes over it. When the gun bolt 2 has reached its most rearward position, the trigger 3 is already reset and held in place by the gun bolt 2.

As the gun bolt 2 begins to move frontward towards the chamber 12 under force from recoil biasing member 11, disconnector 4 sear surface 20 will catch the sear surface 18 of the striker 9 and begin to react against a striker biasing member 10. A new cartridge is simultaneously stripped from a magazine 13 and begins to be pushed by the gun bolt 2 towards the chamber 12. When the gun bolt 2 arrives at its most forward position, a new cartridge will have been loaded in the chamber 12 and the trigger 3 will be clear of interference with the gun bolt 2. This completes a single operating cycle of two strokes. One complete operating cycle is considered 100% of the operating cycle. Subsequent operating cycles can be initiated by subsequent depressions of the trigger 3. Note that in some embodiments, such as shown in FIG. 3, the trigger 3 is blocked from depression by the rigid mechanical contact between the trigger 3 and the gun bolt 2 up to 99% of the operating cycle. The precise percent of the operating cycle can be adjusted to other percentages by a person of skill in the art.

Elaborations

The striker 9 is energized as the gun bolt 2 returns to a most forward position effectively reducing secondary rebound from the chamber face 12.

The trigger 3 may be positively mechanically reset approximately as early as the first 10% of the operating cycle. This may give the user the longest possible time to sense and/or react to the reset event without increasing the overall time between operating cycles.

Clearances between the interference of the trigger 3 and the gun bolt 2 may be adjusted to allow the trigger 3 to be depressed slightly before the most forward movement of the gun bolt 2. In rapid fire operation, this allows for lower "running" trigger pull weight and concurrently shorter striker strokes. Earlier trigger 3 depression results in a shorter striker 9 stroke. The striker biasing member 10 compression is proportionate to the length of striker 9 stroke.

The safety system may automatically lock the trigger 3, the disconnector 4 and the gun bolt 2 simultaneously with a single safety lock 5 upon release of the safety paddle 7 that reacts against safety biasing member 15. The trigger 3 and the disconnector 4 are locked via hook function of the safety lock 5.

When the safety lock 5 is in a locked position, a gun bolt 2 can be in interference with the safety lock 5 and therefore cannot be pulled rearward to cycle a gun bolt 2. In this case, manual operation of the gun bolt 2 requires the safety paddle 7 to be depressed in order to unlock the gun bolt 2.

Ramifications

Self-preservation is the ultimate common determinant of human demands and world history has most certainly indicated that the biggest threat to human beings is found within the same species. The need for more and more advantageous means to defend interest and project interest should be well understood by many people of all cultures familiar to international trade and influence. History also indicates that many, if not the majority of those human versus human threats are acted out at close range with various types of combat tools.

Pistols, carbines, and rifles are primary tools of survival within the scope of modern civilization. These tools are among the most desirable close range fighting tools and are totally indispensable within the context of a civilization of free persons. All free people demand an ability to control and apply the most effective means of self-defense possible.

Flex-Fire Technology is devised to provide a free people a practical means to more effectively defend or project interest at close ranges against other highly developed combat tools that may be applied against them.

This technology provides the potential of increasing both the rate of fire and the precision of fire at higher rates beyond the fundamental design capabilities of pre-existing semi-automatic arms.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved.

Having thus described the invention, it is now claimed:

1. A handheld finger activated semi-automatic arm comprising:

a frame;

a chamber face that is supported to the frame and that comprises a barrel;

a trigger that is depressible to fire the arm once per operating cycle;

a gun bolt that is movable rearward and forward with respect to the frame;

a trigger reset mechanism comprising rigid mechanical contact between the trigger and the gun bolt during an earliest 50% of the operating cycle; and, wherein the trigger is blocked from depression by the rigid mechanical contact between the trigger and the gun bolt up to 99% of the operating cycle.

2. The handheld finger activated semi-automatic arm of claim 1 further comprising:

a safety lock that engages a sear surface on a disconnector to prevent trigger depression.

3. The handheld finger activated semi-automatic arm of claim 1 further comprising:

a striker having an integrated sear surface;

a striker biasing member that biases the striker toward a forward position;

a disconnector having: a first sear surface in contact with the striker sear surface; a second sear surface; and, a pivot that is rearward of the striker sear surface and forward of the disconnector second sear surface;

a safety lock that is adjustable between: a locked condition which prevents the trigger from being depressed and an unlocked condition which permits the trigger to be depressed;

wherein the safety lock contacts the disconnector second sear surface when the safety lock is in the locked condition;

wherein the safety lock is out of contact with the disconnector second sear surface when the safety lock is in the unlocked condition; and, wherein the arm is operable when the safety lock is in the unlocked condition by depressing the trigger to pivot the disconnector about the disconnector pivot, to move the first disconnector sear surface out of contact with the striker sear surface, to enable the striker biasing member to force the striker to fire the arm.

4. The handheld finger activated semi-automatic arm of claim 1 further comprising:

a striker having an integrated sear surface;

a striker biasing member that biases the striker toward a forward position; and, wherein when the gun bolt is moving forward the striker compresses the striker biasing member.

5. The handheld finger activated semi-automatic arm of claim 1 further comprising:

a striker having an integrated sear surface at a rearward end;

a striker biasing member that is positioned above or beside the striker from a lengthwise perspective; and, wherein the striker and striker biasing member are charged only as the gun bolt moves forward toward the chamber face.

* * * * *